United States Patent [19]

Miller

[11] Patent Number: 4,964,816

[45] Date of Patent: Oct. 23, 1990

[54] ELECTRICAL CONNECTOR AND METHOD OF MAKING THE SAME

[75] Inventor: Greg R. Miller, Roanoke, Va.

[73] Assignee: Plastics One, Inc., Roanoke, Va.

[21] Appl. No.: 481,181

[22] Filed: Feb. 20, 1990

[51] Int. Cl.[5] ..... H01R 17/18

[52] U.S. Cl. ..... 439/669; 439/417; 439/425

[58] Field of Search ..... 436/668, 669, 675, 578, 436/583, 584, 585, 790, 798, 409, 413, 417–419, 425, 426

[56] References Cited

U.S. PATENT DOCUMENTS

| | | | |
|---|---|---|---|
| 2,908,884 | 10/1959 | Wirsching | 439/409 |
| 4,726,785 | 2/1988 | Kerboul et al. | 439/417 |
| 4,775,329 | 10/1988 | Verhoeven | 439/394 |
| 4,781,618 | 11/1988 | Geib et al. | 439/417 |
| 4,795,370 | 1/1989 | Freitag | 439/584 |
| 4,869,690 | 9/1989 | Frear et al. | 439/585 |

*Primary Examiner*—David L. Pirlot

*Attorney, Agent, or Firm*—Kenyon & Kenyon

[57] ABSTRACT

Conductive leads are coupled to a plug including an electrically conductive rod shaped member positioned in a dielectric sleeve which is slidably positioned in an electrically conductive barrel shaped member having a dielectric piston slidably positioned therein. A first lead is placed in a first bore in the piston and a second lead is placed between the piston and a cutting edge formed on the barrel shaped member. When the piston is displaced relative to the rod and barrel shaped members, the rod shaped member travels through a second bore in the piston and pierces the insulation surrounding the first lead in the first bore, while the piston forces the second lead against the barrel shape member's cutting edge which penetrates through the insulation surrounding the second lead. As a result, the first lead is electrically coupled to the rod shaped member and the second lead is electrically coupled to the barrel shaped member. The plug construction permits the leads to be coupled to the rod and barrel shaped members simultaneously.

22 Claims, 5 Drawing Sheets

ELECTRICAL CONNECTOR AND METHOD OF MAKING THE SAME

FIELD OF THE INVENTION

The present invention relates to a connector, such as a phone plug, and a method of coupling leads thereto.

BACKGROUND OF THE INVENTION

Typically, electrical connections between conductor leads and phone plugs have included procedures involving soldering, wrapping the conductor leads around screws attached to the plug and then tightening the screws, and crimping the conductor leads to stand-offs or eyelets that are attached to the plug. Among the disadvantages of these connections are: the insulating jacket around the leads normally must be stripped, thereby requiring an additional manufacturing step; connections must be made sequentially, i.e., one lead at a time, thereby reducing manufacturing efficiencies; and subcomponents are generally needed to facilitate soldering or crimping, e.g., stand-offs or eyelets, must be secured to that portion of the plug Which ultimately performs the mating function, e.g., the barrel or center pin, thereby requiring additional parts and manufacturing steps. These subcomponents, also add to the size of the connector making it larger and bulkier. In addition, the electrical connection between these subcomponents and the plug can fail during use, thereby causing plug failure. Accordingly, there is a need to solve these problems and thereby avoid the disadvantages enumerated above.

SUMMARY OF THE INVENTION

The present invention is directed to a method of making a plug assembly that avoids the problems and disadvantages of the prior art. The invention accomplishes this goal by providing a plug having a first electrically conductive member slidably positioned in a second dielectric member which is slidably positioned in a third electrically conductive member having a fourth dielectric member which is slidably positioned therein and slidably positioned over the first conductive member. A first conductive lead is placed between the first and fourth members, While a second conductive lead is placed between the third and fourth members. When the fourth member is displaced relative to the first and third members, the first and third members penetrate the first and second leads, respectively, thereby electrically coupling the leads to the first and third members. The plug construction provides electrical isolation between the leads. One feature of this invention is that the leads can be coupled to their respective conductors simultaneously to increase manufacturing efficiencies. Further, the assembly is made from four components and two leads. Such a relatively small number of parts that make-up the assembly provides a compact device in addition to reducing manufacturing costs.

Another feature of this invention is that the leads need not be stripped. More particularly, the first and third members have edges that can cut through insulation that may encase the conductive core of the leads.

A further feature of the invention is that the leads are held in place by pressure. The first lead is wedged between the first and fourth members, while the second lead is wedged between the third and fourth members.

These connections eliminate the need for soldering or the use of fasteners such as screws, stand-offs or eyelets.

The plug further provides stress-strain relief to the electrical connections, thereby minimizing connection failure. The first lead is coupled to the first member in a bore formed in the fourth member. The inner wall of the bore in the fourth member limits rotational movement of the lead about the first member to reduce stress/strain on the electrical connection between the lead and the first member. In addition, as the first member penetrates and divides the first lead, it wedges the divided portions of the first lead against the inner wall of the bore in the fourth member to secure the electrical connection between the first lead and the first member and provide stress/strain relief therefore. Further, the first member penetrates through the first lead such that the first lead is anchored to the first member. This provides the electrical connection between the first lead and first member with additional stress/strain relief. The third and fourth members are configured such that together they form a stress/strain relief clamp for the electrical connection between the second lead and s third member. Particularly, the fourth member forces the second lead into a recess formed in the third member and clamps the second lead against a seating surface in the recess.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

Figure 1:
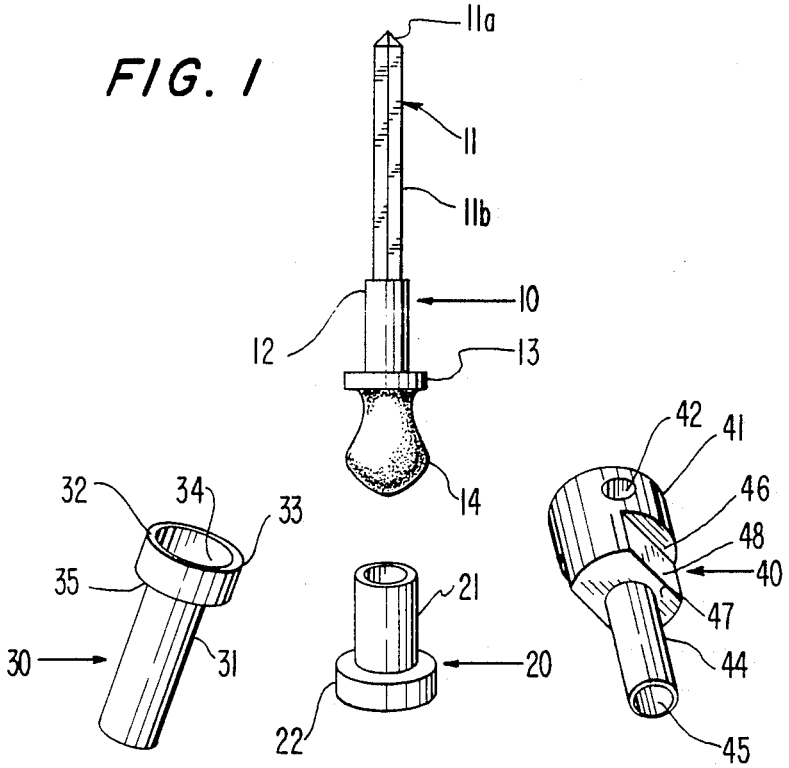
FIG. 1 illustrates the elements of the plug to be assembled in accordance with the principles of the invention.

Referring to the drawings in detail, wherein like numerals indicate like elements, FIG. 1 shows the plug components prior to assembly. More particularly, FIG. 1 shows the two conductors, center pin assembly 10 and barrel shaped member 30, and the two insulators, cylindrical member 20 and piston or head assembly 40, that make-up the plug.

Center pin assembly 10 forms a rod shaped conductor and includes center pin 11 having tapered tip **11*a*, shaft portion 11*b*, cylindrical portion 12, annular flange 13 for supporting cylindrical insulator 20, and tapered leading end 14. Like center pin assembly 10, barrel shaped member 30 is made from electrically conductive material. Barrel shaped conductor 30 includes sleeve portion 31 having annular flange 32 at one end thereof. Rim 33 is formed along one end of annular flange 32 to provide a cutting edge for slicing the insulation of an insulated conductor such as insulated conductors or leads, 51 and 53** as will be described below.

Cylindrical insulator 20 includes sleeve portion 21 having annular flange 22 at one end thereof for supporting barrel shaped conductor 30. Like insulator 20, piston or head assembly 40 is made from material having sufficient dielectric strength to insulate conductors 10 and 30. Head assembly 40 includes piston or head member 41 having radial bore 42 extending therethrough. Head 41 also includes axial bore 43 (FIG. 2) which communicates with radial bore 42 and passageway 45. More particularly, tubular portion 44 extends from head 41 such that passageway 45 is aligned with axial bore 43. Head 4 also includes flat shoulder 46 and flat side surfaces 48 which form recessed portions on radially opposite sides of head 41. Each shoulder 46 is substantially perpendicular to a respective side surface 48.

Figure 2:
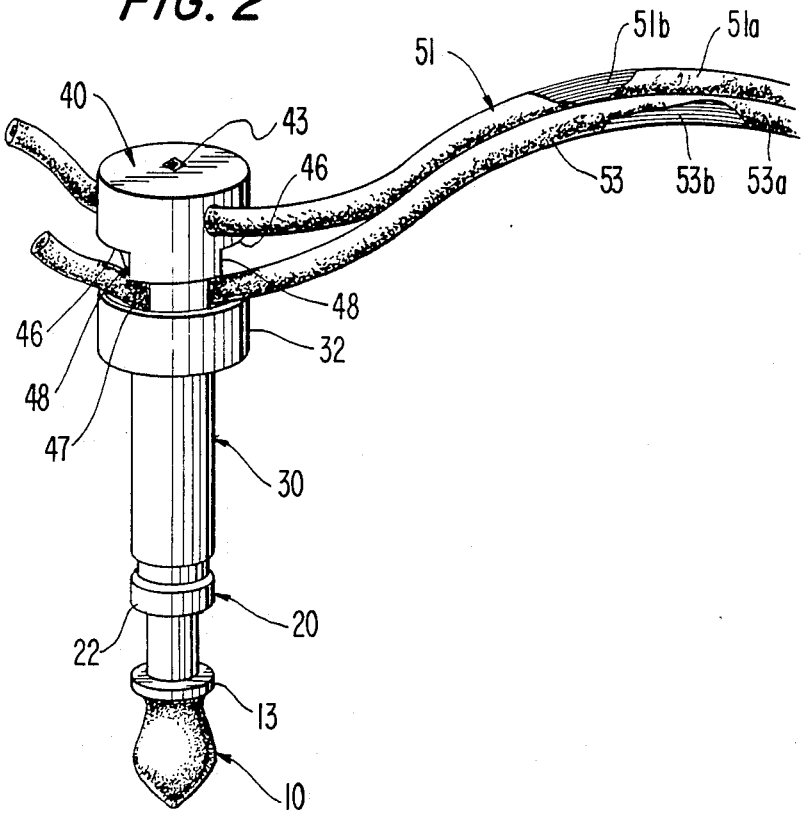
FIG. 2 illustrates an initial stage in assembling the plug.

Referring to FIG. 2, conductors 10, 30 and insulators 20, 40 are pre-assembled prior to connecting leads 51, 53 thereto. Sleeve portion 21 of cylindrical insulator 20 is pressed into sleeve portion 31 of barrel shaped conductor 30. The diameters of sleeve portions 21 and 31 are selected such that sleeve portion 2I snugly fits in sleeve portion 31. The center pin portion of center pin assembly 10 is pressed into the end of cylindrical insulator 20 having annular flange 22 and into barrel shaped conductor 30 to a position approximately 2 millimeters short of its final position. Cylindrical portion 12 of center pin assembly 10 and sleeve portion 21 of cylindrical insulator 20 also should be sized to provide an interference fit therebetween. Head assembly or insulator 40 is pressed down over center pin 11 such that center pin 11 extends into passageway 45 of tubular portion 44, while head 41 remains spaced from annular flange 32. The space between head 41 and flange 32 permits lead 53 to be passed under shoulder 46. Tubular portion 44 and center pin 11 also should be sized to provide an interference fit therebetween. The press fit between elements 10, 20, 30 and 40 permits the assembly to remain partially exploded so that leads 51 and 53 can be properly inserted and connected as described below.

Figure 3:
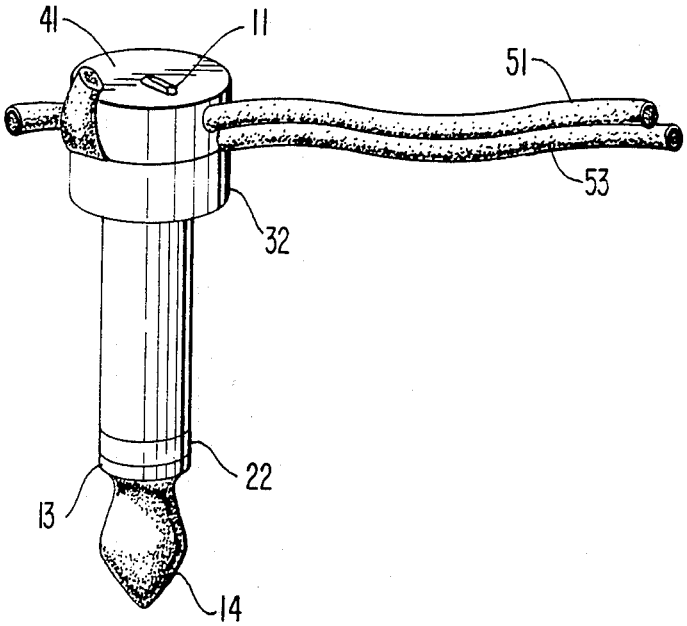
FIG. 3 illustrates the final stage of assembling the plug.
Figure 4:
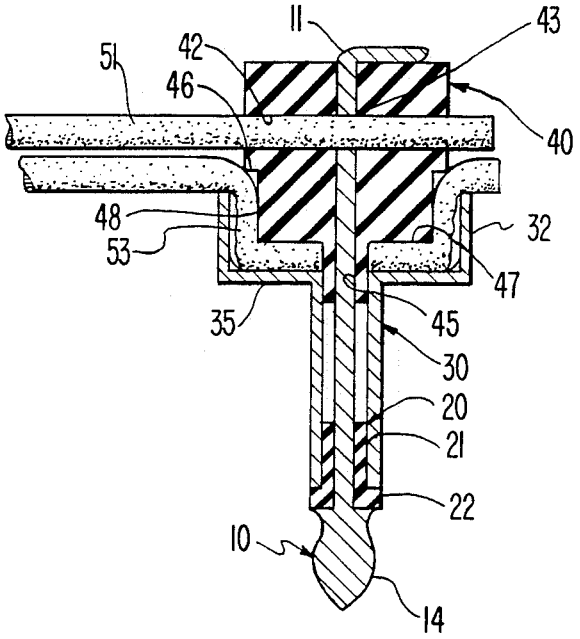
FIG. 4 is a longitudinal cross-section of the plug assembly illustrated in FIG. 3.

Once the plug or pin is assembled as described above, and as illustrated in FIG. 2, it is positioned in an appropriately sized and configured support (not shown) that can be associated with a press or hand tool. Lead 51, which is to be coupled to center pin 11, is inserted through radial bore 42 in insulator head 41. Lead 53, Which is to be coupled to barrel shaped conductor 30, is positioned between bottom surface 47 of insulator head 41 and rim 33 of barrel shaped conductor 30. As insulator 40 is further displaced into barrel shaped conductor 30, center pin 11 passes through insulation or jacket **51*a* and makes an electrical connection between conductor element or core 51*b*, illustrated as comprising strands, and center pin assembly 10, while lead 53 is compressed between rim 33 and head 41 of insulator assembly 40 such that rim 33 pierces insulation 53*a* and makes an electrical connection between conductor element or core 53*b*, also illustrated as comprising strands, and barrel shaped conductor 30 (FIGS. 3 and 4). Referring to FIG. 4, as lead 53 is pressed between head 41 and barrel shaped conductor 30, bottom surface 47 forces a portion of lead 53 into cup shaped interior 34 of barrel shaped conductor 30 and against the inner surface of annular base 35 of annular flange 32. More particularly, as the portion of lead 53 that is forced into the cup shaped interior of barrel shaped conductor 30, that portion bends approximately 90 degrees and extends first along the inner wall of annular flange 32, then between bottom surface 47 and annular base 35 and then up the inner wall of annular flange 32 where it bends approximately 90 degrees again as it leaves the interior of conductor 30. Clearance is provided between the inner Wall of annular flange 32 and side surfaces 48 for lead 53. This clearance is dimensioned such that lead 53 is wedged between the inner wall of rim 33 and side surfaces 48. Thus, once rim 33 pierces insulation 53*a*, side surfaces 48 and the inner wall of annular flange 32 strip insulation 53*a* from lead 53 as lead 53 is forced further into the cup-shaped interior of barrel shaped conductor 30. Accordingly, an electrical connection is made between lead 53 and the inner wall of annular flange 32**.

There is also a clearance between rim 33 and shoulder 46 when bottom surface 47 of head 41 seats against the inner surface of annular base 35. This clearance is dimensioned to provide adequate space for conductor element **53*b*, but not for insulation or jacket 53*a*. Thus, the inside edge of rim 33 only slices through insulation or jacket 53*a* and exposes conductor element 53*b*. The exposed conductor element is wedged against annular flange 32 of barrel conductor 30 providing an electrical connection therebetween. Alternatively, the axial length of tubular portion 44 may be selected to provide clearance between rim 33 and shoulder 46 when the end of tubular portion 44 abuts against the distal end of sleeve portion 21 relative to annular flange 22. (Note: The outer diameters of tubular portion 44 and sleeve portion 21** are substantially the same.)

It should be evident from the above description and the drawings that the electrical connections between lead 51 and rod-like conductor 10 and between lead 53 and barrel shaped conductor 30 can be made simultaneously. Furthermore, a number of such plugs can be supported such that their heads can be actuated together to electrically connect the leads to each plug simultaneously.

Figure 5:
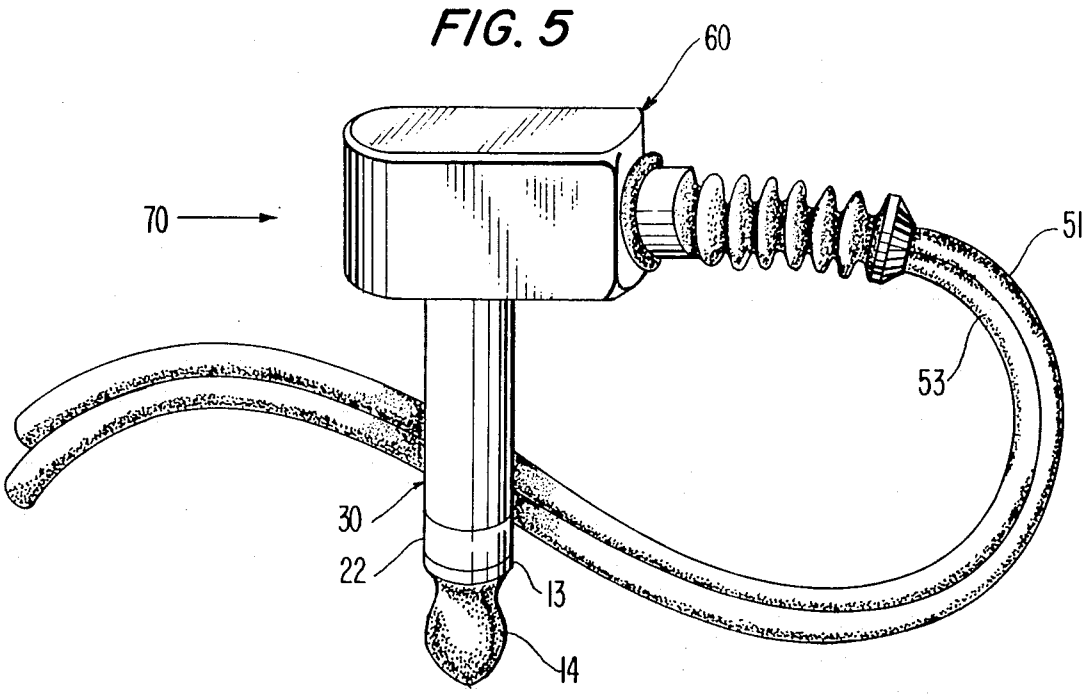
FIG. 5 is a perspective view of the finished plug showing the protective cover therefor.

After center pin 11 has been driven home and the pin has passed through one side of jacket **51*a*, through or beside conductor element 51*b*, through the other side of jacket 51*a*, and through axial bore 43, the pin is in its fully seated position. The plug assembly is then locked together in a suitable manner. For example, the portion of center pin 11 that protrudes beyond axial bore 43 can be bent radially outwardly and anchored against the top surface of head 41 (FIGS. 3 and 4. To finish manufacturing the plug assembly, protective or insulating cover 60 then can be molded over or otherwise associated with the plug, as illustrated in FIG. 5, to complete plug assembly 70. Obviously, other means can be used to lock the plug assembly together without departing from the scope of the present invention. For example, center pin 11 can be anchored by staking, i.e., mushrooming the head or tip of the pin against the top surface of head 41**. Further, a latching mechanism can be used to latch the plug components together.

Referring to FIGS. 3 and 4, cylindrical insulator 20 maintains the desired spacing between barrel shaped conductor 30 and rod shaped conductor 10, while providing insulation therebetween. In addition to insulating center pin 11 from barrel shaped conductor 30, insulator 40 insulates conductor leads 51 and 53 from one another. Furthermore, insulator 40 provides a mechanism to couple leads 51 and 53 to conductors 10 and 30, respectively, while providing the connections therebetween with stress-strain relief when the leads are under load as described below.

When center pin 11 penetrates lead 51, the taper at the end of center pin 11 divides conductive strands **51*b* of lead 51 into at least two portions. As pin 11 is forced further through lead 51, these portions are displaced around pin 11 in the vicinity of bore 43 such that shaft 11*b* of pin 11 tightly wedges strands 51*b* against the inner walls of bore 43 of insulator assembly 40. This provides a secure connection between lead 51 and center pin assembly 10. Further, center pin 11 is embedded in lead 51 such that lead 51 is anchored thereto. As bores 43 and 45 radially restrain center pin 11, lead 51 is anchored in bore 41 and restrained from moving radially therein. This anchorage provides the electrical connection between lead 51 and center pin assembly 10 with stress/strain relief. The pressure developed from lead 51 being wedged between the exterior of center pin 11 and the inner wall of bore 43, provides additional stress/strain relief to the connection. The degree of stress/strain relief can be increased by increasing this pressure. This can be accomplished, for example, by providing center pin shaft 11*b* with a configuration that includes longitudinal edges. To this end, shaft 11*b* can be configured to have, for example, a square, hexagonal or octagonal transverse cross-section. The edges present in these configurations provide higher localized pressure points against lead 51. Although these edges can be rounded to prevent damage to the conductive strands, center pin 11 should have a round cylindrical configuration when lead 51** comprises very soft or tensile conductors or conductors having very fine stranding because the higher pressure producing configurations could damage these types of conductors.

The inner walls of bore 43 also provides stress strain relief. Particularly, the inner walls of bore 43 limit the rotation of lead 51 about the central axis of bores 43 and 45 to further reduce stress/strain on the electrical connection between lead 51 and center pin 11.

The electrical connection between lead 53 and conductor 30 also is provided with stress/strain relief. Head assembly 40 together with the cup shaped interior 34 of barrel shaped conductor 30 form a clamp for lead 53. Bottom surface 47 of head 41 forces lead 53 down into the cup shaped interior 34 of barrel shaped conductor 30 and clamps lead 53 against annular base 35 and the inner walls of annular flange 32 (FIG. 4).

This stress/strain relief clamp connection protects the electrical connection between lead 5 and the inner walls of conductive annular flange 32.

Although a two conductor extruded ribbon or zip type wire assembly 51, 53 is illustrated in the drawings, other configurations of wire, e.g., a twisted pair, a jacketed twisted pair, or stripped wire or noninsulated wire can be used. However, there are certain configurations of wire that must be handled carefully. For example, if the plug components are not displaced carefully, a lead comprising extremely fine gauge stranded wire (i.e., 32 gauge and higher) or a lead comprising a single strand solid conductor may be damaged or broken by the pointed end of center pin 11. However, two components of the plug assembly can be modified to avoid damage to these types of leads when used. First, the tapered end of center pin 11 can be replaced with a blunt end having a flat end surface and a sharp edge thereabout. Further, the diameter of bore 43 above radial bore 42 can be made slightly larger than the diameter of the bore below bore 42 to accommodate the center pin and the lead. Thus, as the pin is forced upwardly, the blunt end of the center pin does not pass through the lead, but instead forces the lead into bore 43 above bore 42. However, the diameter of bore 43 above bore 42 is dimensioned to resist entry of the insulation of the lead. Therefore, once the sharp edge of the blunt end of the center pin initiates a tear in the insulation of the lead, the inner wall of bore 43 strips insulation from the lead as the center pin is further displaced. In this way, the conductive core of the lead is placed in contact with the center pin and secured in place by the pressure effected by the clearance between the inner wall of bore 43 and the center pin.

The above is a detailed description of a particular embodiment of the invention. The full scope oftthe invention is set out in the claims that follow and their equivalents. Accordingly, the claims and specification should not be construed to unduly narrow the full scope of protection to which the invention is entitled.

What is claimed is:

1. A method of making an electrical connector comprising the steps of:

providing a plug having a first electrically conductive member slidably positioned in a second dielectric member which is slidably positioned in a third electrically conductive member having a fourth dielectric member slidably positioned therein and slidably positioned over said first conductive member;

placing a first conductive lead between said first and fourth members and a second conductive lead between said third and fourth members;

coupling said first conductive lead to said first member and said second conductive lead to said third member by displacing said fourth member relative to said first and third members to force said first and third members into said leads; and maintaining said first and second leads electrically isolated.

2. The method of claim 1 wherein the coupling step includes inserting said first lead into a bore formed in said fourth member and displacing said fourth member relative to said first member such that said first member penetrates a portion of said first lead which is disposed in said bore.

3. The method of claim 2 wherein said coupling step includes displacing said first member relative to said fourth member such that said first member pierces a jacket of insulation which surrounds the conductive core of said first lead and wedges the core against said fourth member while maintaining contact with the core.

4. The method of claim 2 further comprising extending said first member entirely through and beyond said fourth member and anchoring the exposed end portion of said first member that extends beyond said fourth member against an outer surface of said fourth member.

5. The method of claim 4 wherein said exposed end portion is bent radially outwardly along said outer surface of said fourth member.

6. The method of claim 4 wherein said exposed end portion is anchored by stamping said end portion against said outer surface of said fourth member.

7. The method of claim 1 wherein said providing step includes providing said third member with an annular rim and said fourth member with a head, and said coupling step includes placing said second lead between said head and an annular rim formed on said third member and displacing said fourth member relative to said third member such that said head forces said second lead against said rim.

8. The method of claim 7 wherein said coupling step includes displacing said fourth member relative to said third member such that said rim slices through a jacket of insulation which surrounds the conductive core of said second lead to form an electrical connection with said second lead.

9. The method of claim 8 wherein said coupling step includes forcing a portion of said second lead into a cup shaped cavity, formed by the inner walls of said rim, and compressing said second lead against an annular seat formed at the base of said cavity.

10. The method of claim 8 wherein said coupling step includes inserting said first lead into a bore formed in said head and displacing said fourth member relative to said first member such that said first member penetrates a portion of said first lead which is disposed in said bore.

11. The method of claim 10 wherein said coupling step includes displacing said fourth member relative to said first member such that said first member pierces a jacket of insulation which surrounds the conductive core of said first lead and wedges the core of said first lead against said fourth member while maintaining contact with the core of said first lead.

12. The method of claim 11 further comprising extending said first member entirely through and beyond said fourth member and anchoring the exposed end portion of said first member that extends beyond said fourth member against an outer surface of said fourth member.

13. A method of making an electrical connector comprising the steps of:

providing a plug with an electrically conductive rod shaped member slidably positioned in a dielectric sleeve which is slidably positioned in an electrically conductive barrel shaped member having a dielectric piston slidably positioned therein and slidably positioned over said rod shaped member;

inserting a first conductive lead, which is encased in insulation, into a bore formed in said piston;

placing a second conductive lead, which is encased in insulation, between said piston and an annular rim which is formed at one end of said barrel shaped member;

slidably displacing said piston relative to said rod and barrel shaped members such that said rod shaped member pierces through the insulation surrounding said first lead and forms an electrical connection with said first lead, while said piston forces said second lead against the rim of said barrel shaped member such that said rim slices through the insulation surrounding said second lead and forms an electrical connection with said second lead; and maintaining said first and second leads electrically isolated.

14. The method of claim 13 wherein said electrical connections are formed simultaneously.

15. The method of claim 14 wherein a plurality of said connectors are made simultaneously.

16. The method of claim 14 wherein a plurality of said plugs are provided, each plug is positioned in a support, and each piston is displaced relative to said rod-like and barrel shaped members ether simultaneously or sequentially.

17. A plug assembly comprising:

an electrically conductive rod shaped member;

a dielectric tubular member surrounding a portion of said rod-like member;

an electrically conductive barrel shaped member having an annular rim formed thereon, said barrel shaped member surrounding a portion of said tubular member;

a dielectric piston having first and second communicating bores, said piston being partially disposed in said barrel shaped member, and said rod shaped member extending into said first bore;

a first conductive lead having a portion disposed in said second bore, said portion being electrically coupled to said rod shaped member at the juncture of said first and second bores; and a second conductive lead having a portion extending between said annular rim and said piston, said portion of said second lead being electrically coupled to said barrel shaped member.

18. The plug assembly of claim 17 wherein said piston includes a recess that forms a shoulder which contacts said second lead while being spaced from said annular rim.

19. The plug assembly of claim 17 wherein said first and second leads are electrically isolated.

20. The plug assembly of claim 19 wherein said rod-like and barrel shaped members are electrically isolated.

21. The plug assembly of claim 17 wherein said piston includes diametrically opposed recesses each of which forms a shoulder that contacts said second lead while being spaced from said annular rim.

22. The plug assembly of claim 21 wherein piston includes a seating surface below said annular rim, a portion of said second lead is fixedly positioned against said seating surface.

* * * * *